United States Patent [19]

Boggs et al.

[11] Patent Number: 4,615,245

[45] Date of Patent: Oct. 7, 1986

[54] METHOD OF CUTTING ELONGATED MATERIAL USING A CUTTER REEL WITH SPACED BLADES

[75] Inventors: Beryl A. Boggs, Richmond; Rob R. Gordon, Jr., Chesterfield, both of Va.

[73] Assignee: Allied Corporation, Morris Township, Morris County, N.J.

[21] Appl. No.: 571,395

[22] Filed: Jan. 17, 1984

[51] Int. Cl.[4] ..... D01G 1/04; B26D 1/12

[52] U.S. Cl. ..... 83/37; 83/346; 83/674; 83/913

[58] Field of Search ..... 83/37, 913, 346, 347, 83/403, 674

[56] References Cited

U.S. PATENT DOCUMENTS

| | | | |
|---|---|---|---|
| 2,234,105 | 3/1941 | Ashton et al. | 83/913 |
| 2,745,491 | 5/1956 | Sonneborn | 83/913 X |
| 3,011,257 | 12/1961 | Bamberger | 83/913 X |
| 3,485,120 | 12/1969 | Keith | 83/913 X |
| 3,733,945 | 5/1973 | Cook | 83/913 X |
| 3,831,481 | 8/1974 | Van Doorn | 83/913 |
| 3,834,263 | 9/1974 | Smith | 83/913 |
| 3,869,268 | 3/1975 | Bnai et al. | 83/913 |
| 4,120,222 | 10/1978 | Potter | 83/913 X |
| 4,300,422 | 11/1981 | Potter | 83/913 X |
| 4,369,681 | 1/1983 | Van Doorn et al. | 83/913 |

*Primary Examiner*—E. R. Kazenske
*Assistant Examiner*—John L. Knoble
*Attorney, Agent, or Firm*—William H. Thrower; Virginia S. Andrews

[57] ABSTRACT

Method and apparatus of simultaneously cutting a plurality of different elongated materials into shorter lengths is provided. The method features the steps of continuously winding a coil of each of the materials about a common axis, each of the coils being separate from one another, while continuously cutting a layer of each of the materials into shorter lengths, and continuously transporting the shorter lengths away. The apparatus features a cutter reel with a plurality of radially spaced cutting blades which form in conjunction with a barrier at least two cutting zones which are separate from one another. The different types of elongated material are fed to the different cutting zones for cutting and removal.

11 Claims, 10 Drawing Figures

METHOD OF CUTTING ELONGATED MATERIAL USING A CUTTER REEL WITH SPACED BLADES

BACKGROUND OF THE INVENTION

1. Field of the Invention

This invention relates to a method and apparatus for cutting elongated material into shorter lengths having predetermined dimensions. More particularly, this invention relates to a method of cutting a plurality of different elongated materials, preferably continuous filament, into shorter lengths at the same time in a single cutter assembly to provide a good mix of the materials. The preferred elongated material of the present invention is continuous filamentary material, preferably of polyester, nylon, Kevlar®, fiberglass, etc.; elongated material may equally be applicable to strips, ribbons, tapes, film, wire or any other flexible material. The material is preferably used as reinforcement for plastic products.

2. The Prior Art

In the current practice of handheld spray molding of plastic products such as bathtubs, showers, boats, etc., glass fibers are fed from a creel package to an air driven cutter mechanism attached to the plastic spray gun. The gun sprays a resin and catalyst into a mold; a cutter simultaneously chops the fiberglass into staple lengths which are mixed with the stream of resin as it exits the spray nozzle of the gun. The cutter mechanism includes cutting blades rotated against a polyurethane covered roll and between which the fiberglass is passed to be cut or broken into lengths corresponding to the spacing of the cutting blades. The design has not proved satisfactory in cutting less brittle materials such as polyester yarn. The present invention is intended to allow elongated materials to be cut into staple lengths and delivered to the spray stream of a handheld spray gun, and in fact, permits the simultaneous cutting of several different elongated materials for formation of hybrid filamentary of reinforcement of plastics.

The abrasive characteristic of fiberglass dulls cutting blades, and therefore, a cutting blade which has been used for cutting fiberglass cannot be used to cut polyester without sharpening or coating the blade. For this reason, fiberglass and polyester fiber cannot be fed together for cutting by the same cutting blades of cutter apparatus. It would be desirable to overcome this problem for purposes of obtaining a good mix of shorter lengths of the two.

A portable device adapted to break fibers into short lengths and to direct the same onto a surface being coated is disclosed in U.S. Pat. No. 3,011,257 to Bamberger, hereby incorporated by reference. Glass rovings are continuously drawn into the bite of oppositely turning rollers, one of which has circumferentially spaced chopping bars thereon which engage the other roller and break the fibers into short sections when passed therebetween.

Many other types of cutting devices and methods for dividing elongated material into shorter lengths are known. Specifically, reference should be had to U.S. Pat. Nos. 3,485,120 to Keith, 3,733,945 to Cook, 4,120,222 to Potter and 4,300,422 to Potter, all of which are hereby incorporated by reference. All of these cutters are broadly used for cutting tow of very high denier into staple length fibers. The cutter of the Keith patent includes a rotatable reel having outwardly facing cutting blades against which the tow is wound; a fixed pressure roller pressing upon the tow wound around the reel results in cutting of the innermost layers of tow by the cutting blade. As cutting progresses a wad of cut staple fibers is forced inwardly between adjacent pairs of blades. The other patents are directed to modifications of the Keith apparatus for removal of the cut fibers.

SUMMARY OF THE INVENTION

A method and apparatus of simultaneously cutting a plurality of different elongated materials into shorter lengths is provided.

The method comprises the steps of: continuously winding a coil of each of the materials about a common axis, each of the coils being separate from one another; continuously cutting a layer of each of the materials into shorter lengths; and continuously transporting the shorter lengths away. The cutting preferably occurs during the winding step by the layers being continuously forced against at least one cutting blade. The coils may be wound with either the innermost layers thereof bearing against and being cut by the cutting blades or with the outermost layers thereof bearing against and being cut by the cutting blades. It is preferred that the cutting blades be mounted in a spaced relationship and define a closed geometrical figure, the cutting blades being rotated as a unit. When the innermost layers of the coils are cut by the cutting blades it is preferred that the coils be wound around the cutting blades.

Another method of the present invention comprises the steps of: continuously feeding the elongated materials to a plurality of cutting blades and extending a layer of each of the materials substantially parallel to but separate from one another across and in contact with each two adjacent cutting blades of the plurality of cutting blades so that a layer of each of the materials is in touch, lightly tensioned contact with the cutting blades; and applying a pressure against the layers of each material to thereby force the layers against the cutting blades to cut the layers into the shorter lengths. Again, it is preferred that the cutting blades be mounted in spaced relationship and define a closed geometrical figure, with the plurality of different elongated materials being wrapped thereabout. It is also preferred that the cutting blades be rotated as a unit and that the elongated materials be continuously fed onto the rotating cutting blade unit.

Another, alternate method comprises the steps of: continuously feeding the different elongated materials to a plurality of cutting blades and extending a layer of each of the materials substantially parallel to but separate from one another across and and in contact with a cutting blade of the plurality of cutting blades in turn; and applying a pressure against the layers of each material to thereby force said layers against the cutting blades to cut the layers into the shorter lengths.

The present invention also provides an improved apparatus for cutting elongated material into predetermined lengths. The apparatus comprises a cutting assembly including a plurality of cutting blades secured to a reel having an upper and a lower mounting member and having means adapted to receive successive wrapping of elongated material to be cut in contact with the plurality of cutting blades and means for forcing the material between adjacent cutting blades to a doffing point thereby severing the elongated material into lengths of controlled dimensions. The improvement comprises a barrier connected to and dividing the cutting blades into cutting zones which are separate from one another. Different types of elongated material may be wrapped for cutting in each cutting zone.

The present invention also provides a cutter reel for simultaneously cutting a plurality of different elongated materials into shorter lengths, comprising at least one generally circular frame member and a plurality of cutting blades, connected to the frame member and forming therewith at least two cutting zones separated by the frame member(s). Each of the elongated materials is cut in one of the cutting zones. The most preferred cutter reel of the present invention comprises at least three generally circular frame members, held in axially spaced relationship by a plurality of cutting blades, which extend between the frame members and form therewith at least two cutting zones, each cutting zone being located between two of the frame members. Most preferably, each of the cutting blades is a continuous blade, the ends of which terminate in the outermost frame members, and the effective diameter of each of the frame members is essentially identical. The wraps of yarn, consisting generally of at least one layer, have their innermost strands of filaments forced in contact sequentially with the blade edges by one or more pressure applying devices, generally a roller or rollers, mounted adjacent the reel-like member. The pressure applying device does not contact the cutting blade edges; the blade edges, frame members and pressure applicator form in combination a pressure chamber from which the material contained escapes, after cutting, to the interior of the cutter reel.

DESCRIPTION OF THE PREFERRED EMBODIMENT

Figure 1:
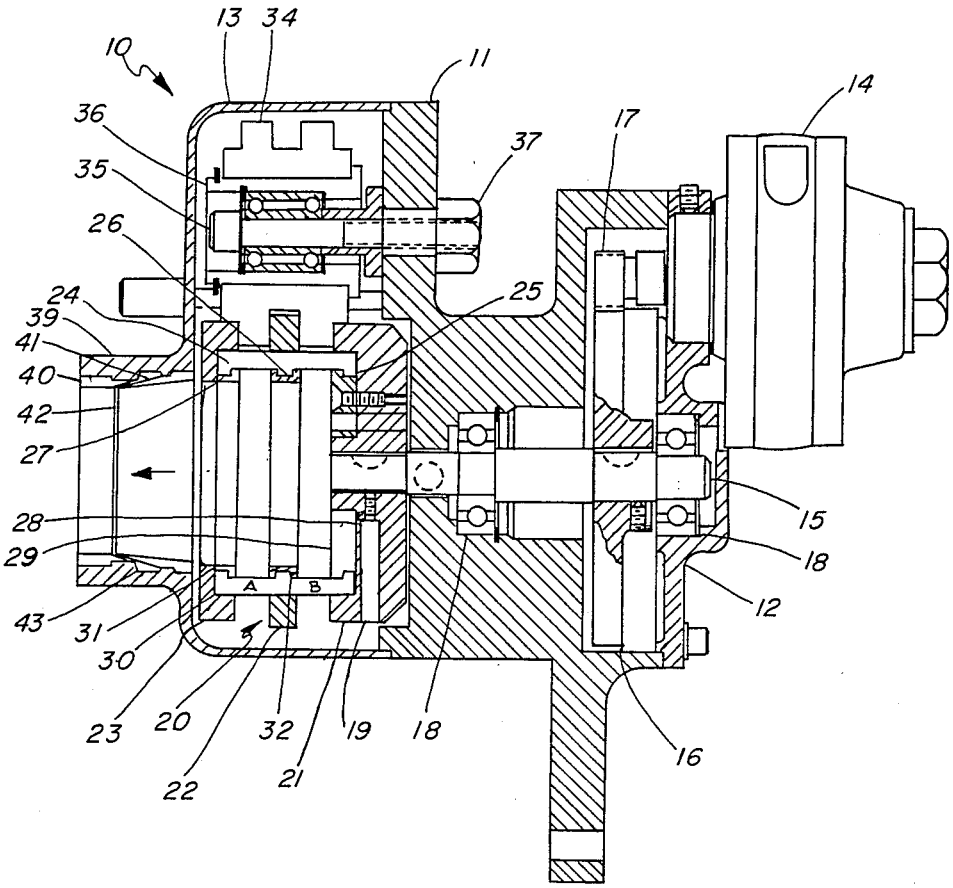
FIG. 1 is a full section of the cutter 10 of the present invention.
Figure 3:
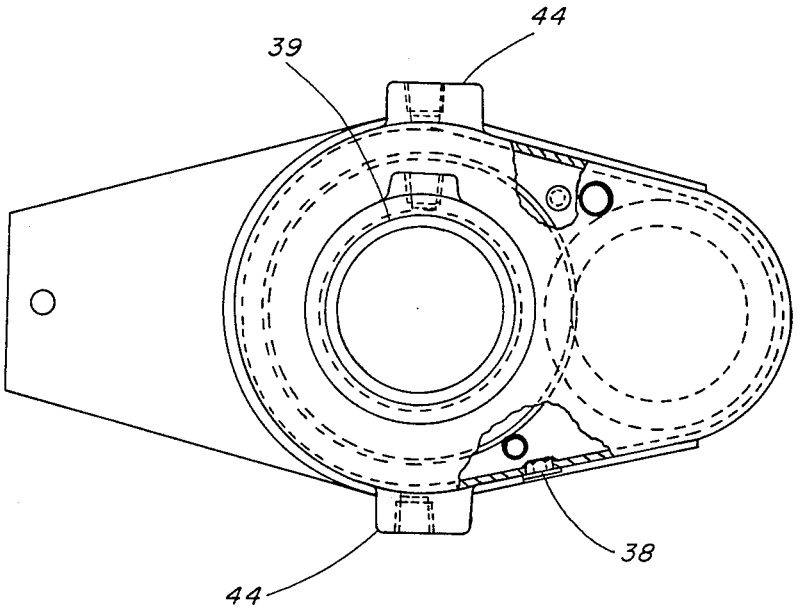
FIG. 3 is a front view, partially cut away, of cutter 10.

In the accompanying drawings like numbers indicate like apparatus. With reference to FIGS. 1 and 3, the cutter 10, preferably for use in a spray-up system, comprises cutter base 11, cutter back plate 12 which is screwed on to cutter base 11, and cutter cover 13 which is bolted to cutter base 11. Motor 14 is mounted to back plate 12. Output shaft 15 is conventionally connected to motor 14 via spur gear 16 and pinion gear 17. Output shaft 15, in turn, is mounted to back plate 12 and cutter base 11 via bearings 18. Output shaft 15 is connected to frame member 21 of cutter reel 20 via a Woodruff key (unshown) and set screw 19.

Cutter reel 20 includes a plurality of E-shaped cutting blades 24 with three small tabs 25, 26 and 27 on their inner side to facilitate mounting. Blade tabs 25 are placed in recess 28 of cutter reel frame member 21 and retained therein by cap 29 which is bolted to cutter reel frame member 21. Cutting blade tabs 27 are placed in recess 30 of cutter reel frame member/rim 23 and retained therein by cap 31 which is bolted to rim/cutter reel frame member 23. Center blade tabs 26 are a locator for ring 32 which is attached to annular barrier/frame member 22 by screws (unshown). Barrier frame member 22 separates each blade 24 into separate cutting zones A and B. (See FIGS. 1, 7 and 8). The effective diameter of cutter reel 20, which is the diameter of the closed geometrical figure formed by cutting blades 24, is approximately 3.03 inches (7.70 cm).

Pressure roll 34 is mounted in a fixed, spaced relationship to cutting blades 24 and barrier frame member 22. Pressure roll 34 rides on frame members 21 and 23. Pressure roll 34 is mounted via bolt 35 passing through bearing 36 (in center of pressure roll 34) and into cam nut 37 in a conventional manner. Pressure roll 34 is shaped to accommodate barrier frame member 22, i.e., with two annular flanges, which with cutting blades 24 and frame members 21, 22 and 23 form two cutting zones A and B, to which different types of continuous filament yarn are fed.

Cutter cover 13 is bolted to cutter base 11 to cover the mechanism of cutter reel 20 and pressure roll 34. Guides 38 and cutter cover 13 (FIG. 3) provide access for fiber to feed around cutting blades 24. Guides 38 could alternatively be located in cutter base 11 for easier removal of cutter cover 13.

Discharge nozzle 39 forms part of cutter cover 13. There are two inserts 40 and 41 press fit into discharge nozzle 39 and having a tiny gap 42 there between running the inner circumference of discharge nozzle 39. Air is introduced into a plenum 43 from an unshown source, gap 42 intersecting plenum 43 and providing for discharge of the air at nozzle 39. Shape of inserts 40 and 41 is such that total air flow is amplified. Discharge of air from gap 42 produces an aspirating affect on the cutting cavity enclosed by cutter cover 13 and cutter base 11 to eliminate stagnant air zones around cutter reel 20 and pressure roll 34.

Figure 2:
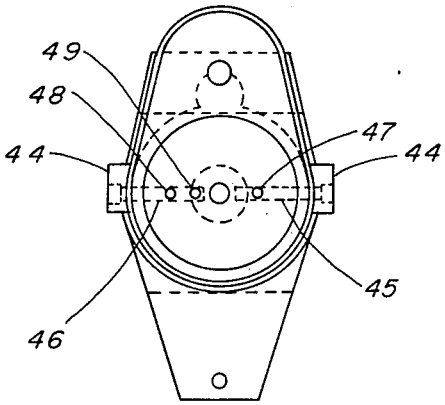
FIG. 2 is a front view of the cutter base 11.
Figure 4:
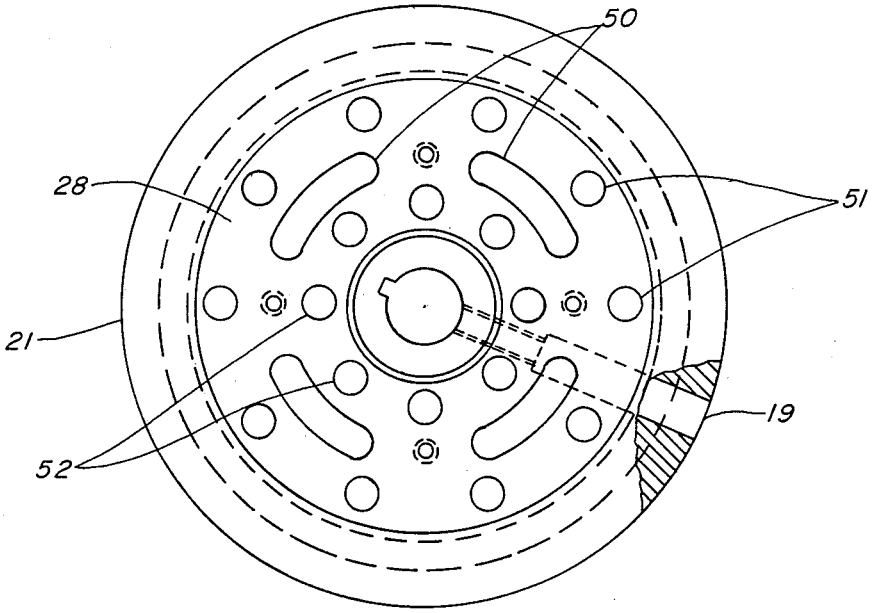
FIG. 4 is a front view with a partial section of frame member 21.

With reference to FIG. 2, nozzles 44 feed air from an external source (unshown) into opposing ports 45 and 46 in cutter base 11. Port 45 has a single orifice 47 while port 46 has two orifices 48 and 49. Cap 29 and frame 21 have a plurality of aligned slots 50 and holes 51 and 52 as shown in FIG. 4. When cap 29 and frame member 21 are rotated, orifice 49 intermittently communicates with holes 52, orifice 48 intermittently communicates with holes 51 and orifice 47 intermittently communicates with slots 50.

The following steps detail operation of the cutter 10. Cutter cover 13 is removed to permit stringup of two different types of yarn 53 and 54 through guides 38 for wrapping two or three turns around cutting blades 24 in cutting zones A and B, respectively. Cutter cover 13 is replaced; and the air supply is then cut on to nozzles 44 to produce air flow through cutter reel 20. The air supply is then cut on to plenum 43 and ultimately discharge nozzle 39 to produce air flow through cutter reel 20 and discharge nozzle 39 in the direction of the arrow in FIG. 1. Then motor 14 is cut on, which ultimately results in rotation of cutter reel 20. Cutter reel 20 turns at up to 1200 revolutions per minute (rpm), most preferably 1000 rpm [about 277 to 334 feet per minute (1.41 to 1.70 meter per second)].

Figure 6:
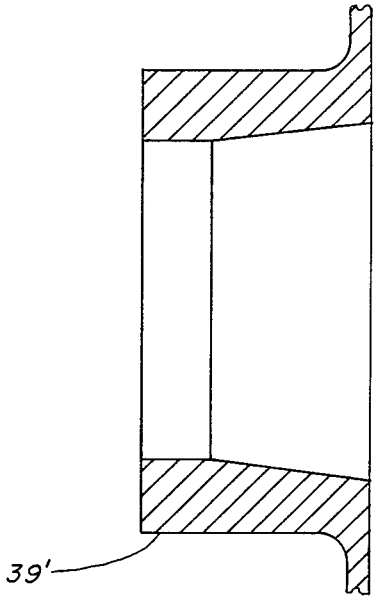
FIG. 6 is a section of an alternate discharge nozzle 39'.

A straight extension (unshown) of discharge nozzle 39 may be desirable depending upon end use. When an extension is used, the amplified air flow achieved through use of inserts 40 and 41 and an external air source may be necessary. An alternate discharge nozzle 39' is shown in FIG. 6. Nozzle 39' is a piece of straight tubing without inserts or an external source of air.

Figure 5:
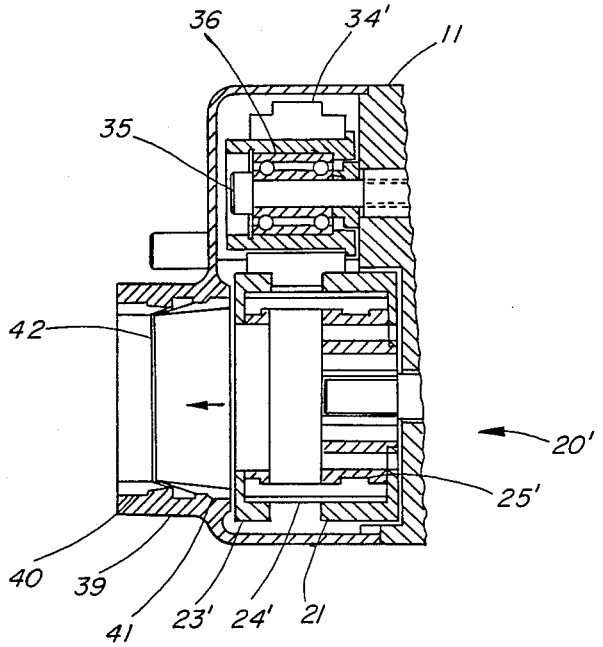
FIG. 5 is a section which includes cutter reel 20' in conjunction with pressure roll 34' for processing one type of fiber.

FIG. 5 is a section which includes cutter reel 20' in conjunction with pressure roll 34' for processing one type of fiber. Primary modification to the apparatus of FIG. 1 involves deleting barrier 22 with accompanying ring 32 (and 22) as well as locator tabs 26 on cutting blades 24. Also, pressure roll 34' has a single annular flange, which with cutting blades 24 and frame members 21 and 23 form a single cutting zone, to which a single type of continuous filament yarn is fed. Utilizing this arrangement, yarn of up to about 40 000 denier, preferably 30 000 denier or less, can readily be cut. In all other respects, operation of this apparatus is the same as that detailed for the FIG. 1 apparatus.

Figure 7:
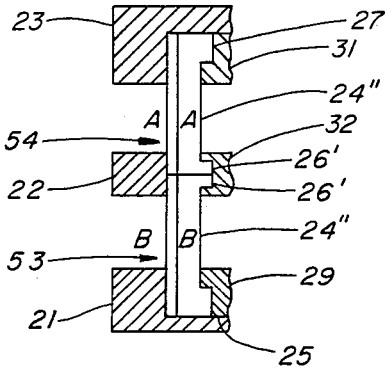
FIGS. 7 and 8 are sections which show alternate arrangements of cutting blades 24.
Figure 8:
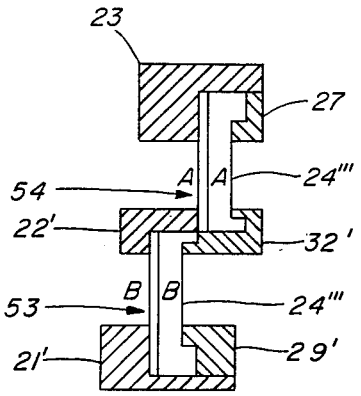

FIGS. 7 and 8 are sections which show alternate arrangements of cutting blades 24. In FIG. 7 two blades 24'' are utilized in lieu of a single cutting blade 24. With reference to FIG. 8, not only are two blades 24''' substituted for each single blade 24 of the FIG. 1 apparatus, but the effective diameter of the cutting zone differs from one another although they share a common axis. It is contemplated that more than two zones can be provided with varying effective diameters and frame members to accommodate same. By varying the effective diameters of the cutting zones, one can vary the amount of fiber cut for mixing. An alternate way to achieve this is to utilize cutter reel 20 wherein the effective diameter of the cutting zones is identical but yarns of different denier are fed to the respective cutting zones.

Figure 9:
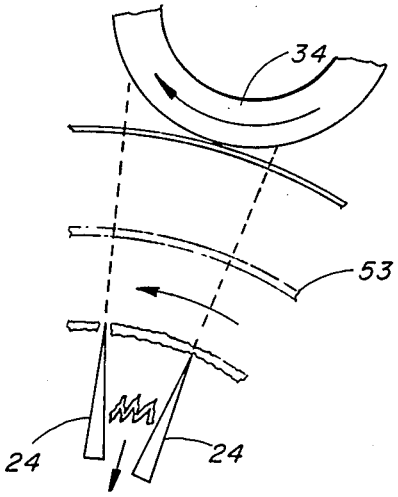
FIGS. 9 and 10 are enlarged, fragmentary, detailed views showing the relationship between the blades 24, the material 53 being severed and pressure roll 34 at the point of cutting.
Figure 10:
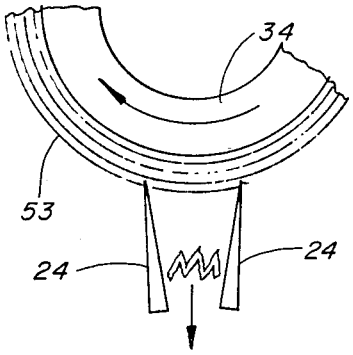

FIG. 9 shows the preferred method of the present invention wherein the filamentary material 53 is continuously wound in a coil with its innermost layer contacting blade 24. FIG. 10, however, depicts an alternate embodiment of the present invention wherein filamentary material 53 is continuously wound in a coil about pressure roll 34 and the outermost layers or wraps of the coil contact blades 24 for cutting. Reference U.S. Pat. No. 3,945,280 to Roncato, hereby incorporated by reference.

The number of cutting blades 24 chosen is dependent upon the length of cut fiber desired.

EXAMPLE 1

The apparatus of FIGS. 1–4 was utilized. Fiberglass 53 and polyester yarn 54 were fed respectively to cutter zones B and A for cutter reel 20 through guides 38. Cutter reel 20 includes approximately 10 cutting blades [0.035 inch (0.089 cm) thick, 0.313 inch (0.794 cm) wide and 1.88 inch (4.77 cm) long]. The cut fiber had a length of approximately one inch (2.54 cm). Cutting blades 24 were a solid tungsten carbide alloy and pressure roll 34 had a polyurethane surface. Two packages of 9000 denier polyethylene terephthalate and two packages of 207 yield fiberglass were fed to achieve approximately a 50/50 by volume mixture of cut fibers. Cutter reel 20 was rotating at approximately 1000 rpm. In a subsequent trial one package of 9000 denier polyethylene terephthalate was fed along with two packages of 207 yield fiberglass to their respective zones to attempt a 3:1 by volume ratio of fiberglass to polyethylene terephthalate. The gap between pressure roller 34 and blades 24 was approximately 0.0625 inch (0.1587 cm). The cut staple was free to fall toward the center of cutter reel 20 and was ejected axially from the center of reel 20 with the aid of air jets as previously described. The fiberglass and polyester yarn wound in their respective cutting zones around the blades 24 of cutter reel 20 until the yarn contacted pressure roller 34 after which the first wrap or innermost layers against the cutting blades 24 were cut due to the increased force of the increasing number of yarn wraps/layers between cutting blades 24 and pressure roll 34.

What is claimed is:

1. A method of simultaneously curring a plurality of diferent elongated materials into shorter lengths, comprising the steps of:

a. continuously winding a coil of each of said materials about a common axis, each of said coils being separate from one another;

b. continuously forcing a layer of each of said materials against a specific portion of a cutting blade to cut each of said materials into said shorter lengths; while c. confining that specific portion of the cutting blade which cuts one of said materials to contact only said one material; and d. continuously transporting the shorter lengths away.

2. The method of claim 1 wherein said cutting occurs during said winding step.

3. The method of claim 2 wherein said coils are wound with the innermost layers thereof bearing against and being cut by at least one cutting blade.

4. The method of claim 3 wherein the innermost layers are wound about a plurality of cutting blades mounted in spaced relationship and defining a closed geometrical figure, said cutting blades being rotated as a unit.

5. The method of claim 2 wherein said coils are wound with the outermost layers thereof bearing against and being cut by at least one cutting blade.

6. The method of claim 5 wherein the outermost layers bear against a plurality of cutting blades mounted in spaced relationship and defining a closed geometerical figure, said cutting blades being rotated as a unit.

7. A method of simultaneously cutting a plurality of different elongated materials into shorter lengths, comprising the steps of: continuously feeding the elongated materials to a plurality of cutting blades and extending a layer of each of the materials substantially parallel to one another, with each of the different materials separate from one another, across and in contact with each two adjacent cutting blades of the plurality of cutting blades so that a layer of each of the materials is in touch, lightly tensioned contact with the cutting blades; applying a pressure against the layers of each material to thereby force each of said layers against a specific portion of said cutting blades to cut said layers into said shorter lengths; and confining that specific portion of the cutting blades which cuts one of said materials to contact only said one material.

8. The method of claim 7 wherein said cutting blades are mounted in spaced relationship and define a closed geometrical figure with the plurality of different elongated materials being wrapped thereabout.

9. The method of claim 8 wherein said cutting blades are rotated as a unit.

10. The method of claim 9 wherein the elongated materials are continuously fed onto the rotating cutting blade unit.

11. A method of simultaneously cutting a plurality of different elongated materials into shorter lengths, comprising the steps of: continuously feeding the elongated materials to a plurality of cutting blades and extending a layer of each of the materials substantially parallel to one another, with each of the different materials separate from one another, across and in contact with a cutting blade of the plurality of cutting blade in turn; applying a pressure against the layers of each material to thereby force each of said layers against a specific portion of said cutting blades to cut said layers into said shorter lengths; and confining that specific portion of the cutting blade which cuts one of said materials to contact only one material.

* * * * *